US010488118B2

(12) United States Patent
Kono et al.

(10) Patent No.: US 10,488,118 B2
(45) Date of Patent: Nov. 26, 2019

(54) HEAT EXCHANGER WITH LIQUID RECEIVER

(71) Applicant: SANDEN AUTOMOTIVE CLIMATE SYSTEMS CORPORATION, Isesaki-shi, Gunma (JP)

(72) Inventors: Shinji Kono, Isesaki (JP); Yoshito Ozawa, Isesaki (JP)

(73) Assignee: Sanden Automotive Climate Systems Corporation, Isesaki-shi, Gunma (JP)

( * ) Notice: Subject to any disclaimer, the term of this patent is extended or adjusted under 35 U.S.C. 154(b) by 95 days.

(21) Appl. No.: 15/572,283

(22) PCT Filed: May 6, 2016

(86) PCT No.: PCT/JP2016/063641
§ 371 (c)(1),
(2) Date: Nov. 7, 2017

(87) PCT Pub. No.: WO2016/185917
PCT Pub. Date: Nov. 24, 2016

(65) Prior Publication Data

US 2018/0149432 A1 May 31, 2018

(30) Foreign Application Priority Data

May 19, 2015 (JP) ..... 2015-101826

(51) Int. Cl.
*F28F 9/02* (2006.01)
*F28D 7/00* (2006.01)
(Continued)

(52) U.S. Cl.
CPC ..... *F28D 7/0066* (2013.01); *F25B 39/00* (2013.01); *F28F 9/002* (2013.01); *F28F 9/013* (2013.01);
(Continued)

(58) Field of Classification Search
CPC ..... F25B 39/04; F25B 2339/044; F25B 2339/0441; F25B 2339/0443; F28F 9/002; F16B 2/08
See application file for complete search history.

(56) References Cited

U.S. PATENT DOCUMENTS 5,697,431 A * 12/1997 Nagasaka ..... F28F 9/002 165/149
6,209,348 B1 * 4/2001 Shinmura ..... F25B 39/04 165/110
(Continued)

FOREIGN PATENT DOCUMENTS

GB 512627 A * 9/1939 ..... F16L 3/127
JP 60-093598 U 6/1985
(Continued)

OTHER PUBLICATIONS

Japan Patent Office; International Search Report issued in International Application No. PCT/JP2016/063641, dated Jul. 16, 2016.

*Primary Examiner* — Eric S Ruppert
(74) *Attorney, Agent, or Firm* — Baker Botts L.L.P.

(57) ABSTRACT

To allow an end plate 5 on one side of a heat exchanger to support a liquid receiver 20 in a preferable manner, the present invention provides the following structure: The end plate 5 is formed to have a C-shaped cross section, having a pair of reinforcing ribs 18A, 18B protruding outward in the right-left direction from the front and back edges of the end plate 5. A fixing band 30 includes: an embracing portion 31 formed in a loop for embracing the liquid receiver 20; an attaching portion 32 (a pair of attaching pieces 32A, 32B) to the end plate 5, the attaching portion 32 being formed continuously with the embracing portion 31; and a reinforcing portion 33 formed integrally with the attaching portion 32 (attaching piece 32A) so as to be fitted between the pair of reinforcing ribs 18A, 18B.

7 Claims, 5 Drawing Sheets

(51) Int. Cl.

| | |
|---|---|
| ***F25B 39/00*** | (2006.01) |
| ***F28F 9/26*** | (2006.01) |
| ***F28F 9/00*** | (2006.01) |
| ***F28F 9/013*** | (2006.01) |

(52) U.S. Cl.
CPC ..... *F28F 9/02* (2013.01); *F28F 9/26* (2013.01); *F25B 2339/0441* (2013.01)

(56) References Cited

U.S. PATENT DOCUMENTS

| | | | | |
|---|---|---|---|---|
| 2005/0120739 | A1 | 6/2005 | Brost | |
| 2005/0126764 | A1 | 6/2005 | Alinovi et al. | |
| 2013/0284400 | A1* | 10/2013 | Iino | F28D 1/05375 165/76 |
| 2017/0089368 | A1* | 3/2017 | Oozeki | F15B 15/2892 |

FOREIGN PATENT DOCUMENTS

| | | | | | |
|---|---|---|---|---|---|
| JP | 04-103973 | A | | 4/1992 | |
| JP | 06300476 | A | * | 10/1994 | F28F 9/002 |
| JP | 08-075317 | A | | 3/1996 | |
| JP | 09-196259 | A | | 7/1997 | |
| JP | 09-317949 | A | | 12/1997 | |
| JP | 2005-114348 | A | | 4/2005 | |
| JP | 2009-208668 | A | | 9/2009 | |
| JP | 2013-204905 | A | | 10/2013 | |

* cited by examiner

HEAT EXCHANGER WITH LIQUID RECEIVER

CROSS-REFERENCE TO RELATED APPLICATIONS

This application is a U.S. National Stage Patent Application under 37 U.S.C. § 371 of International Patent Application No. PCT/JP2016/063641, filed May 6, 2016, which claims the benefit of Japanese Patent Application No. JP 2015-101826, filed May 19, 2015, the disclosures of each of which are incorporated herein by reference in their entirety.

TECHNICAL FIELD

The present invention relates to a heat exchanger with a liquid receiver (receiver tank), the heat exchanger being primarily used as a condenser in a vehicle air conditioner.

BACKGROUND ART

Patent Documents 1 and 2 disclose a heat exchanger (condenser) with a liquid receiver. In the condenser, high-temperature, high-pressure gaseous refrigerant is cooled, condensed, and liquefied by exchanging heat with air for air conditioning. The liquid receiver (receiver tank) temporarily stores the refrigerant that flowed through the condenser, and discharges only liquid refrigerant.

The condenser disclosed in Patent Documents 1 and 2 is a horizontal flow type, including a core portion, a pair of right and left header tanks, and a pair of upper and lower end plates. Refrigerant horizontally flows through the core portion while exchanging heat with external air. The right and left header tanks are vertically disposed at the right and left ends of the core portion. The upper and lower end plates are horizontally disposed at the upper and lower ends of the core portion.

In Patent Document 1, a commonly used vertical liquid receiver, which is designed to be vertically disposed, is used. The liquid receiver is disposed along and fixed to one of the header tanks.

In Patent Document 2, a special horizontal liquid receiver, which is designed to be horizontally disposed, is used. The liquid receiver is disposed along and fixed to the upper end plate.

REFERENCE DOCUMENT LIST

Patent Documents

Patent Document 1: JP H04-103973 A
Patent Document 2: JP H08-075317 A

SUMMARY OF THE INVENTION

Problems to be Solved by the Invention

Recently, a heat pump cycle for a vehicle air conditioner is being developed. In a heat pump cycle, an exterior heat exchanger functions not only as a condenser, but also as an evaporator, and thus, a vertical flow type heat exchanger is becoming mainstream in consideration of drainage capability and the like. Such a vertical flow type heat exchanger includes a core portion, a pair of upper and lower header tanks, and a pair of right and left end plates. Refrigerant vertically flows through the core portion while exchanging heat with external air. The upper and lower header tanks are horizontally disposed at the upper and lower ends of the core portion. The right and left end plates are vertically disposed at the right and left ends of the core portion.

In view of gas-liquid separation and the like, it is desirable to use a vertical liquid receiver. Such a vertical liquid receiver is typically fixed to the heat exchanger by coupling a lower end portion thereof to the heat exchanger, and by fixing an upper end portion thereof to the heat exchanger with a fixing band that embraces the upper end portion so as to allow absorption of vibration from a vehicle.

Accordingly, in contrast to a horizontal flow type heat exchanger in which the fixing band that embraces the liquid receiver may be attached to one of the header tanks, the fixing band that embraces the liquid receiver needs to be attached to one of the end plates in a vertical flow type heat exchanger.

Each of the end plates is formed to have a C-shaped cross section (formed in a channel shape), having a pair of reinforcing ribs (raised portions) protruding outward in the right-left direction from the front and back edges of the end plate. The fixing band is attached to the reinforcing ribs of one of the end plates.

However, the end plates are lower in strength than the header tanks. Thus, fixing the fixing band to one of the end plates causes problems due to insufficient strength of the end plate, such as deformation of the reinforcing ribs.

The present invention has been made in view of the above circumstances. An object of the present invention is to provide a heat exchanger with a liquid receiver which includes a vertical flow type heat exchanger capable of supporting a vertical liquid receiver in a preferable manner, and which can be manufactured with excellent efficiency.

Means for Solving the Problems

A heat exchanger with a liquid receiver according to the present invention includes: a core portion through which refrigerant vertically flows while exchanging heat with external air; a pair of upper and lower header tanks horizontally disposed at upper and lower ends of the core portion; a pair of right and left end plates vertically disposed at right and left ends of the core portion; the liquid receiver being cylindrical and disposed along any one of the right and left end plates; and a fixing band for fixing the liquid receiver to the end plate.

Each of the end plates is formed to have a C-shaped cross section (formed in a channel shape), having a pair of reinforcing ribs protruding outward in a right-left direction from front and back edges of the end plate.

The fixing band includes: an embracing portion formed in a loop for embracing the liquid receiver; an attaching portion to the end plate, the attaching portion being formed continuously with the embracing portion; and a reinforcing portion formed integrally with the attaching portion so as to be fitted between the pair of reinforcing ribs.

Effects of the Invention

According to the present invention, in the fixing band which embraces a vertical liquid receiver, the attaching portion to one of the end plates is provided with the reinforcing portion formed integrally with the attaching portion so as to be fitted between the pair of reinforcing ribs of the end plate. Accordingly, when the reinforcing ribs of the end plate and the attaching portion of the fixing band are fixed together using a bolt and the like, the reinforcing portion integrally formed with the attaching portion is fitted between the pair of reinforcing ribs and thereby reinforces the reinforcing ribs. This restricts the deformation and the like of the reinforcing ribs, thus allowing the vertical liquid receiver to be supported in a preferable manner.

Moreover, the fixing band is fixed to the end plate with the bolt and the like in the state in which the reinforcing portion formed integrally with the attaching portion is fitted between the pair of reinforcing ribs. This facilitates positioning and the like thereof, and thus allows the structure according to the present invention to be manufactured with excellent efficiency.

MODES FOR CARRYING OUT THE INVENTION

Embodiments of the present invention will be described in detail below.

Figure 1:
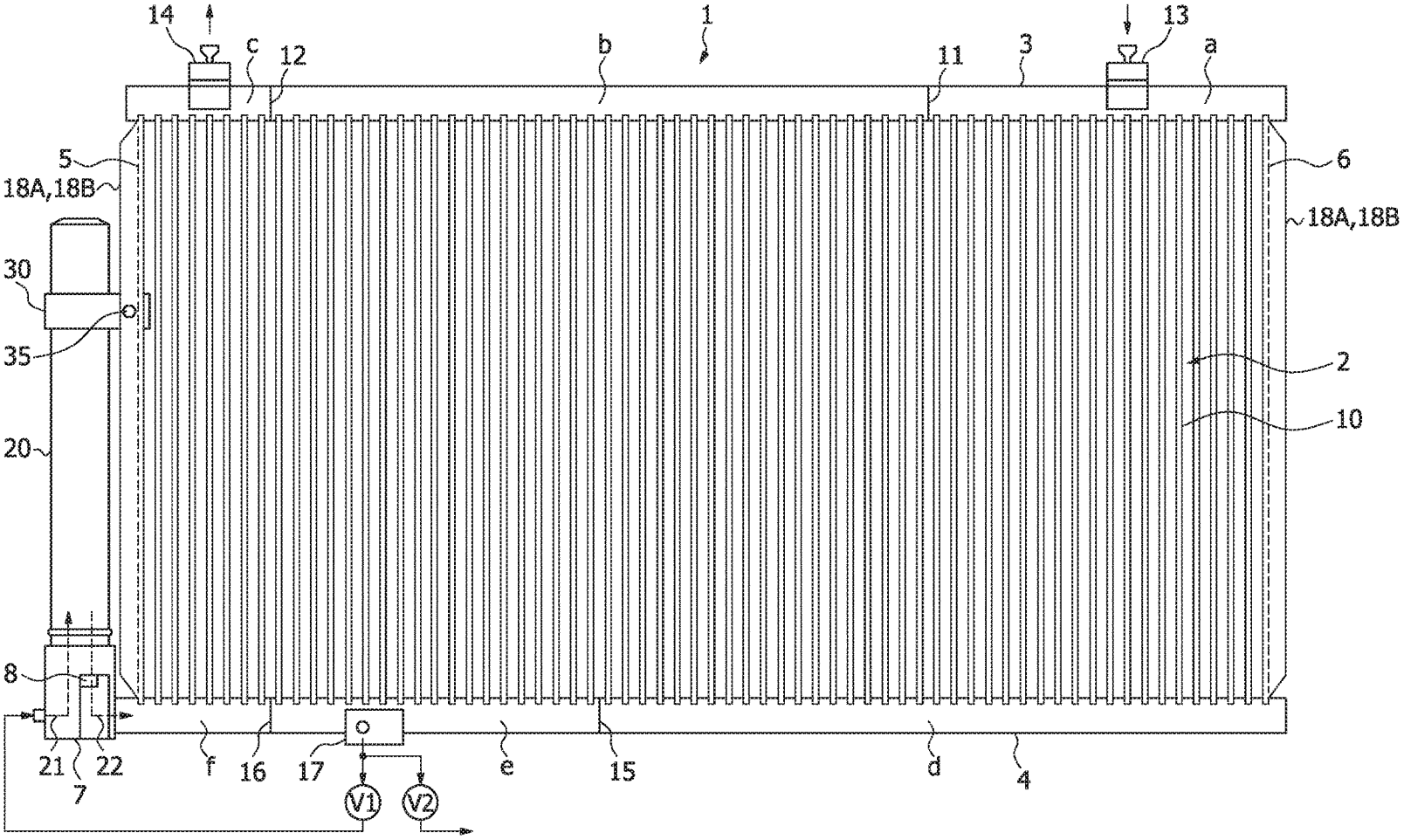
FIG. 1 is an overall view of a heat exchanger with a liquid receiver according to an embodiment of the present invention.

FIG. 1 is an overall view of a heat exchanger with a liquid receiver according to an embodiment of the present invention.

Being an exterior heat exchanger of a heat pump cycle, a heat exchanger 1 according to this embodiment functions as a condenser during air cooling operation, and functions as an evaporator during air heating operation.

The heat exchanger 1 includes a core portion 2, a pair of upper and lower header tanks 3, 4, a pair of right and left end plates (side plates) 5, 6, and a connector 7, which are integrally joined together by furnace brazing. Refrigerant vertically flows through the core portion 2 while exchanging heat with external air. The upper and lower header tanks 3, 4 are horizontally disposed at the upper and lower ends of the core portion 2. The right and left end plates 5, 6 are vertically disposed at the right and left ends of the core portion 2. The connector 7 is connected to one end of the lower header tank 4.

The core portion 2 includes a large number of vertically extending flat tubes 10. The flat tubes 10 are disposed at predetermined intervals in the right-left direction. Each flat tube 10 has a flat cross-sectional shape lengthened in the front-back direction (direction perpendicular to the plane of FIG. 1). Air flows between the flat tubes 10 in this front-back direction. A corrugated fin (not shown) is disposed between each adjacent two flat tubes 10, 10, i.e. between each adjacent two flat surfaces of the flat tubes 10. The fins define air flow channels extending in the air flow direction.

The pair of upper and lower header tanks 3, 4 are horizontally extending cylindrical tanks. The upper header tank 3 communicates with the upper ends of the flat tubes 10. The lower header tank 4 communicates with the lower ends of the flat tubes 10. In other words, the large number of flat tubes 10 are arranged in parallel so that each flat tube 10 communicates with the pair of upper and lower header tanks 3, 4.

The upper header tank 3 is divided into three chambers a, b, c by two partition walls 11, 12 provided in the interior of the upper header tank 3.

The upper header tank 3 is provided with a refrigerant inlet 13 and a refrigerant outlet 14. The refrigerant inlet 13 communicates with the far-right chamber a, and the refrigerant outlet 14 communicates with the far-left chamber c.

The lower header tank 4 is divided into three chambers d, e, f by two partition walls 15, 16 provided in the interior of the lower header tank 4.

The lower header tank 4 is provided with a refrigerant outlet 17 and the connector 7. The refrigerant outlet 17 communicates with the center chamber e, and the connector 7 communicates with the far-left chamber f.

The pair of right and left end plates 5, 6 are disposed on opposite ends of the row of the flat tubes 10 of the core portion 2. The upper and lower ends of each of the right and left end plates 5, 6 are integrally fixed respectively to the header tanks 3, 4.

Figure 3:
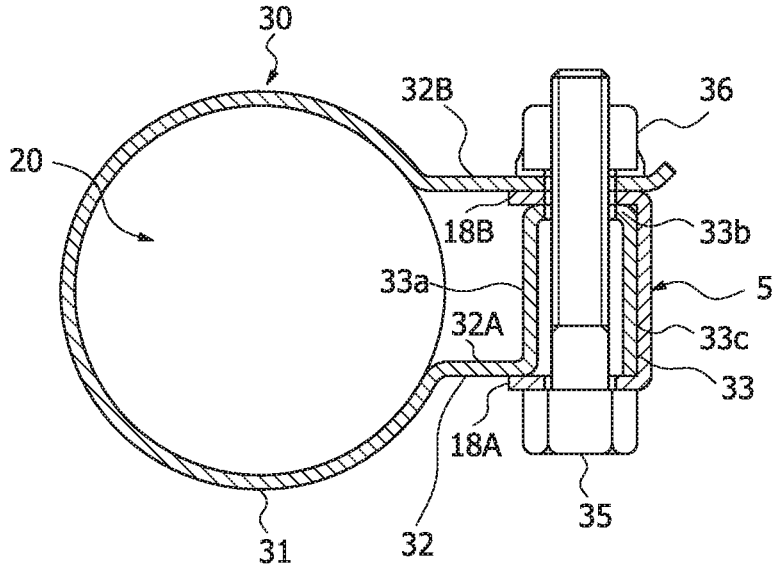
FIG. 3 is a cross-sectional view of the area where the liquid receiver is fixed (cross-sectional view taken along A-A line of FIG. 2).

Each of the end plates 5, 6 is formed to have a C-shaped cross section (formed in a channel shape), having a pair of reinforcing ribs (raised portions) 18A, 18B protruding outward in the right-left direction from the front and back edges of the end plate 5, 6 (see FIG. 3).

A liquid receiver (receiver tank) 20 is a vertical cylindrical tank disposed along the end plate 5. The bottom of the liquid receiver 20 is disposed on the top of the connector 7, which is integrally fixed to the one end of the lower header tank 4, and fixed thereto with a bolt 8.

The liquid receiver 20 has a refrigerant inlet and a refrigerant outlet in the bottom, and temporarily stores refrigerant therein. The liquid receiver 20 houses and holds desiccant in an upper portion thereof, thereby provided with a function of removing water from the refrigerant.

The connector 7 has an inlet passage 21 and an outlet passage 22. Through the inlet passage 21, the refrigerant entering from the outside is supplied to the refrigerant inlet of the liquid receiver 20. Through the outlet passage 22, the refrigerant discharged from the refrigerant outlet of the liquid receiver 20 is supplied to the chamber f of the lower header tank 4.

An upper portion of the liquid receiver 20 is fixed to the end plate 5 with a fixing band 30 so as to allow absorption of vibration from a vehicle. Specifically, one end side of the fixing band 30 embraces the upper portion of the liquid receiver 20, and the other end side of the fixing band 30 is fixed to the end plate 5 with a bolt 35.

The flow of refrigerant through the heat exchanger 1 with the liquid receiver 20 will be described below.

The refrigerant having entered the chamber a through the refrigerant inlet 13 of the upper header tank 3 (which is high-temperature, high-pressure gaseous refrigerant having been compressed by a compressor during air cooling operation) flows downward through the flat tubes 10 that communicate with the chamber a. The refrigerant exchanges heat with external air while flowing downward through the flat tubes 10, and then enters the chamber d of the lower header tank 4.

The refrigerant having entered the chamber d of the lower header tank 4 flows upward through the flat tubes 10 that communicate with a left-hand region of the chamber d, while exchanging heat with external air. Then, the refrigerant enters the chamber b of the upper header tank 3.

The refrigerant having entered the chamber b of the upper header tank 3 flows downward through the flat tubes 10 that communicate with a left-hand region of the chamber b, while exchanging heat with external air. Then, the refrigerant enters the chamber e of the lower header tank 4.

During air cooling operation, high-temperature, high-pressure gaseous refrigerant having been compressed by the compressor (not shown) enters the heat exchanger 1 through the refrigerant inlet 13 and flows in a manner as described above. Thus, while flowing through the flat tubes 10, the high-temperature, high-pressure gaseous refrigerant is condensed and liquefied by dissipating heat to external air. Thus, the heat exchanger 1 functions as a condenser during air cooling operation.

During air cooling operation, the refrigerant having entered the chamber e of the lower header tank 4 is discharged out through the refrigerant outlet 17. Then, the refrigerant enters the inlet passage 21 of the connector 7 through a valve V1, which opens during air cooling operation. Thereby, the refrigerant is supplied to and temporarily stored in the liquid receiver 20.

After the refrigerant is stored in the liquid receiver 20, only liquid refrigerant enters the chamber f of the lower header tank 4 through the outlet passage 22 of the connector 7.

The refrigerant having entered the chamber f of the lower header tank 4 flows upward through the flat tubes 10 that communicate with the chamber f, while being further cooled (supercooled) by exchanging heat with external air. Then, the refrigerant enters the chamber c of the upper header tank 3.

The refrigerant having entered the chamber c of the upper header tank 3 is discharged out through the refrigerant outlet 14 and flows toward a decompression means (not shown), such as an expansion valve.

Thus, the refrigerant having been condensed and supercooled by the heat exchanger 1 is adiabatically expanded and decompressed by the decompression means such as the expansion valve. Then, the resultant gas-liquid two-phase refrigerant enters an interior evaporator. In the interior evaporator, the gas-liquid two-phase refrigerant is heated and vaporized by exchanging heat with air for air conditioning. The air thus cooled in the interior evaporator is blown out through one or more appropriate air outlets so as to cool the vehicle interior air.

During air heating operation, the refrigerant having been condensed by the interior condenser is adiabatically expanded and decompressed by the decompression means such as the expansion valve. Then, the resultant gas-liquid two-phase refrigerant enters the upper header tank 3 through the refrigerant inlet 13 and flows in a manner as described above. Thus, while flowing through the flat tubes 10, the gas-liquid two-phase refrigerant is vaporized by absorbing heat from external air. Thus, the heat exchanger 1 functions as an evaporator during air heating operation.

During air heating operation, the refrigerant having entered the chamber e of the lower header tank 4 is discharged out through the refrigerant outlet 17. Then, the refrigerant flows toward the compressor (not shown) through a valve V2, which opens during air heating operation.

The high-temperature, high-pressure gaseous refrigerant having been compressed by the compressor enters the interior condenser. In the interior condenser, the high-temperature, high-pressure gaseous refrigerant is cooled, condensed, and liquefied by exchanging heat with air for air conditioning. The air thus heated in the condenser is blown out through one or more appropriate air outlets so as to heat the vehicle interior air.

Next, with reference to FIGS. 2 to 4, a fixing structure for the liquid receiver 20 will be described in more detail below.

Figure 2:
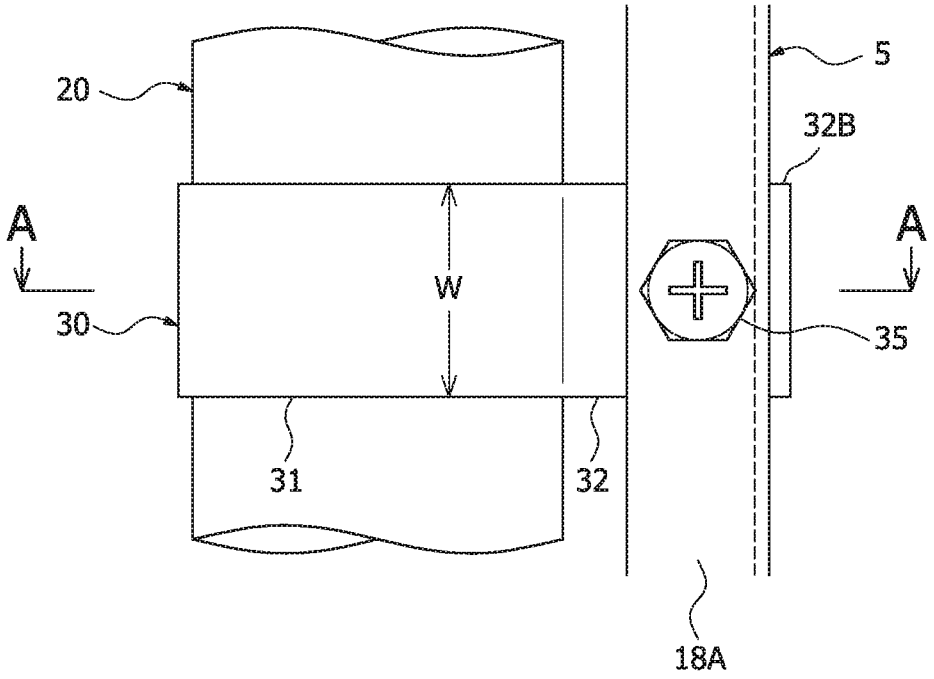
FIG. 2 is an enlarged view of the area where the liquid receiver is fixed.

FIG. 2 is an enlarged view of the area where the liquid receiver is fixed in FIG. 1. FIG. 3 is a cross-sectional view of the area where the liquid receiver is fixed (cross-sectional view taken along A-A line of FIG. 2). FIG. 4 is a detached view of the fixing band.

The fixing band 30 includes an embracing portion 31, an attaching portion 32 to the end plate 5, and a reinforcing portion 33. The embracing portion 31 is formed in a loop for embracing the liquid receiver 20. The attaching portion 32 is formed continuously with the embracing portion 31. The reinforcing portion 33 is formed integrally with the attaching portion 32 so as to be fitted between the pair of reinforcing ribs 18A, 18B.

The embracing portion 31, the attaching portion 32, and the reinforcing portion 33 of the fixing band 30 have the same width as each other in the axial direction of the liquid receiver 20 (the width indicated by W in FIG. 2).

The attaching portion 32 includes a pair of attaching pieces 32A, 32B extending from the opposite ends of the embracing portion 31. The reinforcing portion 33 is formed integrally with the attaching piece 32A.

In this embodiment, the reinforcing portion 33 includes a first reinforcing section 33*a*, a second reinforcing section 33*b*, and a third reinforcing section 33*c*. The first reinforcing section 33*a* extends toward the attaching piece 32B from a bend at the outer end of the attaching piece 32A. The second reinforcing section 33*b* extends in parallel with the attaching piece 32B from an outward bend at the end, farther away from the attaching piece 32A, of the first reinforcing section 33*a*. The third reinforcing section 33*c* extends in parallel with the first reinforcing section 33*a* from a bend at the outer end of the second reinforcing section 33*b*.

In other words, the reinforcing portion 33 is bent so as to form a dipper shape together with the attaching piece 32A, which corresponds to the handle part of the dipper shape.

The length of each of the first reinforcing section 33*a* and the third reinforcing section 33*c* is substantially equal to the distance between the reinforcing ribs 18A, 18B of the end plate 5. Accordingly, the first reinforcing section 33*a* and the third reinforcing section 33*c* are fitted between the reinforcing ribs 18A, 18B of the end plate 5, being thereby able to reinforce the reinforcing ribs 18A, 18B.

The third reinforcing section 33*c* is disposed in parallel with a plate surface of the end plate 5 (in parallel with the bottom surface of the channel shape).

The attaching piece 32A and the reinforcing portion 33 (the first to third reinforcing sections 33*a*, 33*b*, 33*c*) formed integrally with the attaching piece 32A are disposed between the reinforcing ribs 18A, 18B of the end plate 5. The attaching piece 32B is disposed external to the reinforcing rib 18B. In this state, the fixing band 30 is fixed to the end plate 5 with a nut 36 and the bolt 35 inserted through the reinforcing ribs 18A, 18B and the reinforcing portion 33 and the attaching piece 32B.

Accordingly, the end plate 5 has bolt insertion holes formed beforehand at locations, where the fixing band 30 is attached, in the reinforcing ribs 18A, 18B.

Also, the fixing band 30 has bolt insertion holes formed beforehand at corresponding locations in the attaching piece 32B and the second reinforcing section 33*b* formed integrally with the attaching piece 32A.

The nut 36 is disposed external to the bolt insertion hole of the attaching piece 32B of the fixing band 30. In this embodiment, a weld nut is used as the nut 36 and is fixed beforehand to the attaching piece 32B by welding.

In this embodiment, the attaching pieces 32A, 32B extending from the opposite ends of the loop of the fixing band 30 embracing the liquid receiver 20 are disposed in the following manner: The attaching piece 32A is disposed such that the reinforcing portion 33 (the first to third reinforcing sections 33*a*, 33*b*, 33*c*) formed integrally with the attaching piece 32A is fitted between the reinforcing ribs 18A, 18B of the end plate 5, and the attaching piece 32B is disposed on the back side of the reinforcing rib 18B. Thus, the reinforcing rib 18B is sandwiched between the attaching piece 32B and the second reinforcing section 33*b* formed integrally with the attaching piece 32A.

In this state, the bolt 35 is inserted sequentially through the front reinforcing rib 18A, the second reinforcing section 33*b* formed integrally with the attaching piece 32A, the back reinforcing rib 18B, and the attaching piece 32B. Then, the bolt 35 is screwed and secured into the nut 36 that is welded to the attaching piece 32B. In this way, the fixing band 30 is fixed to the end plate 5.

In the above structure, the reinforcing portion 33 (the first to third reinforcing sections 33*a*, 33*b*, 33*c*) integrally formed with the attaching piece 32A is fitted between the pair of reinforcing ribs 18A, 18B, thereby reinforcing the reinforcing ribs 18A, 18B. This restricts the deformation and the like of the reinforcing ribs 18A, 18B, thus allowing the vertical liquid receiver 20 to be supported in a preferable manner. In addition, such a reinforcing structure can be implemented only by sheet-metal processing of the fixing band 30.

Moreover, the fixing band 30 is fixed to the end plate 5 with the bolt 35 and the like in the state in which the reinforcing portion 33 formed integrally with the attaching portion 32 is fitted between the pair of reinforcing ribs 18A, 18B. This facilitates positioning and the like thereof, and thus allows the structure according to this embodiment to be manufactured with excellent efficiency.

Furthermore, the nut 36 is welded beforehand to the attaching piece 32B. This greatly facilitates the assembly work.

Next, with reference to FIGS. 5 and 6, another embodiment of the present invention will be described.

Figure 5:
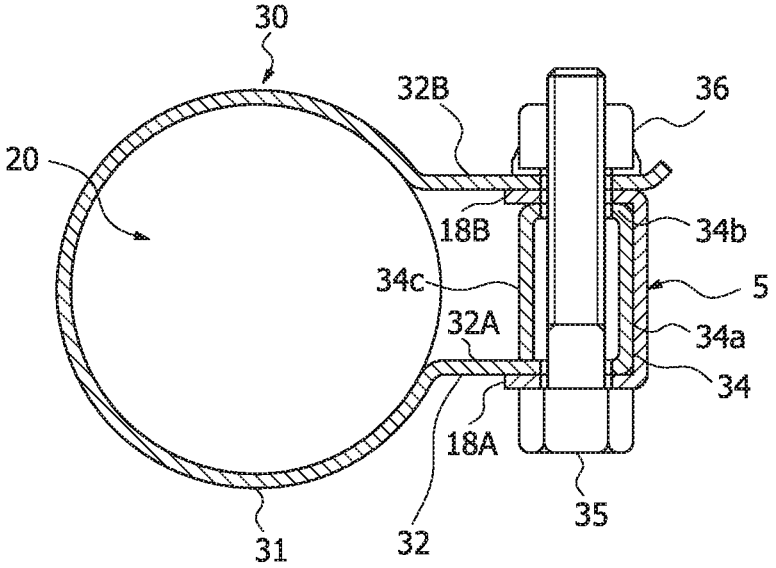
FIG. 5 is a cross-sectional view of the area where the liquid receiver is fixed according to another embodiment of the present invention.

FIG. 5 is a cross-sectional view of the area where the liquid receiver is fixed (corresponding to the cross-sectional view taken along A-A line of FIG. 2). FIG. 6 is a detached view of the fixing band.

The fixing band 30 includes an embracing portion 31, an attaching portion 32 to the end plate 5, and a reinforcing portion 34. The embracing portion 31 is formed in a loop for embracing the liquid receiver 20. The attaching portion 32 is formed continuously with the embracing portion 31. The reinforcing portion 34 is formed integrally with the attaching portion 32 so as to be fitted between the pair of reinforcing ribs 18A, 18B.

The embracing portion 31, the attaching portion 32, and the reinforcing portion 34 of the fixing band 30 have the same width as each other in the axial direction of the liquid receiver 20 (the width indicated by W in FIG. 2).

The attaching portion 32 includes the pair of attaching pieces 32A, 32B extending from the opposite ends of the embracing portion 31. The reinforcing portion 34 is formed integrally with the attaching piece 32A.

In this embodiment, the reinforcing portion 34 includes a first reinforcing section 34*a*, a second reinforcing section 34*b*, and a third reinforcing section 34*c*. The first reinforcing section 34*a* extends toward the attaching piece 32B from a bend at the outer end of the attaching piece 32A. The second reinforcing section 34*b* extends in parallel with the attaching piece 32B from an inward bend at the end, farther away from the attaching piece 32A, of the first reinforcing section 34*a*. The third reinforcing section 34*c* extends in parallel with the first reinforcing section 34*a* from a bend at the inner end of the second reinforcing section 34*b* so as to be in contact with the attaching piece 32A.

Accordingly, in this embodiment, the first reinforcing section 34*a* is located external to the third reinforcing section 34*c*.

In other words, the reinforcing portion 34 is bent back in a C-shape or U-shape from the outer end of the attaching piece 32A.

The length of each of the first reinforcing section 34*a* and the third reinforcing section 34*c* is substantially equal to the distance between the reinforcing ribs 18A, 18B of the end plate 5. Accordingly, the first reinforcing section 34*a* and the third reinforcing section 34*c* are fitted between the reinforcing ribs 18A, 18B of the end plate 5, being thereby able to reinforce the reinforcing ribs 18A, 18B.

The third reinforcing section 34*c* is disposed in parallel with the plate surface of the end plate 5 (in parallel with the bottom surface of the channel shape).

The attaching piece 32A and the reinforcing portion 34 (the first to third reinforcing sections 34*a*, 34*b*, 34*c*) formed integrally with the attaching piece 32A are disposed between the reinforcing ribs 18A, 18B of the end plate 5. The attaching piece 32B is disposed external to the reinforcing rib 18B. In this state, the fixing band 30 is fixed to the end plate 5 with the nut 36 and the bolt 35 inserted through the reinforcing ribs 18A, 18B and the reinforcing portion 34 and the attaching piece 32B.

Accordingly, the end plate 5 has bolt insertion holes formed beforehand at locations, where the fixing band 30 is attached, in the reinforcing ribs 18A, 18B.

Also, the fixing band 30 has bolt insertion holes formed beforehand at corresponding locations in the attaching pieces 32A, 32B and the second reinforcing section 34*b*.

The nut 36 is disposed external to the bolt insertion hole of the attaching piece 32B of the fixing band 30. In this embodiment, a weld nut is used as the nut 36 and is fixed beforehand to the attaching piece 32B by welding.

In this embodiment, the attaching pieces 32A, 32B extending from the opposite ends of the loop of the fixing band 30 embracing the liquid receiver 20 are disposed in the following manner: The attaching piece 32A is disposed such that the reinforcing portion 34 (the first to third reinforcing sections 34*a*, 34*b*, 34*c*) formed integrally with the attaching piece 32A is fitted between the reinforcing ribs 18A, 18B of the end plate 5, and the attaching piece 32B is disposed on the back side of the reinforcing rib 18B. Thus, the reinforcing rib 18B is sandwiched between the attaching piece 32B and the second reinforcing section 34*b* formed integrally with the attaching piece 32A.

In this state, the bolt 35 is inserted sequentially through the front reinforcing rib 18A, the attaching piece 32A, the second reinforcing section 34*b* formed integrally with the attaching piece 32A, the back reinforcing rib 18B, and the attaching piece 32B. Then, the bolt 35 is screwed and secured into the nut 36 that is welded to the attaching piece 32B. In this way, the fixing band 30 is fixed to the end plate 5.

In the above structure, the reinforcing portion 34 (the first to third reinforcing sections 34*a*, 34*b*, 34*c*) integrally formed with the attaching piece 32A is fitted between the pair of reinforcing ribs 18A, 18B, thereby reinforcing the reinforcing ribs 18A, 18B. This restricts the deformation and the like of the reinforcing ribs 18A, 18B, thus allowing the vertical liquid receiver 20 to be supported in a preferable manner. In addition, such a reinforcing structure can be implemented only by sheet-metal processing of the fixing band 30. In particular, the structure according to this embodiment also has a high buckling resistance.

Moreover, the fixing band 30 is fixed to the end plate 5 with the bolt 35 and the like in the state in which the reinforcing portion 34 formed integrally with the attaching portion 32 is fitted between the pair of reinforcing ribs 18A, 18B. This facilitates positioning and the like thereof, and thus allows the structure according to this embodiment to be manufactured with excellent efficiency.

Furthermore, the nut 36 is welded beforehand to the attaching piece 32B. This greatly facilitates the assembly work.

Figure 7:
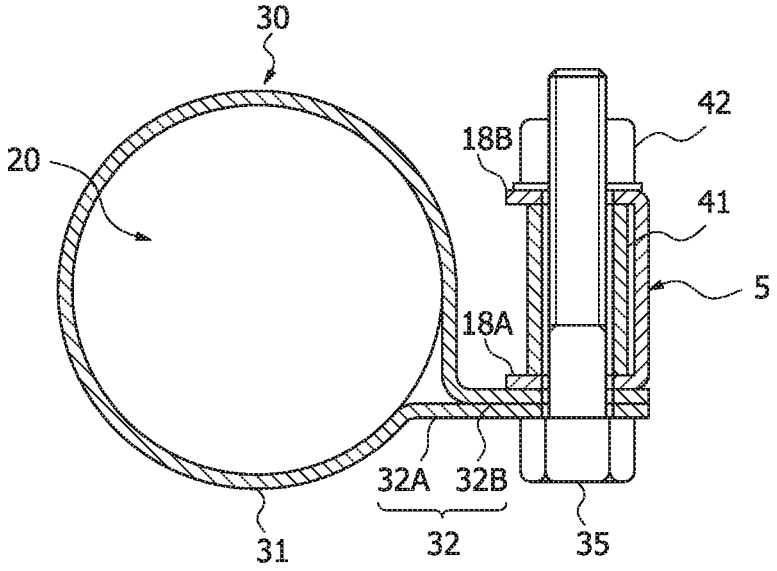
FIG. 7 shows a comparative example.

With reference to FIG. 7, a comparative example will be described below.

In the comparative example shown in FIG. 7, a cylindrical collar 41 for reinforcement is inserted between the pair of reinforcing ribs 18A, 18B of the end plate 5.

In the comparative example, the bolt 35 is inserted sequentially through the attaching pieces 32A, 32B, the reinforcing rib 18A, the collar 41, and the reinforcing rib 18B, and then is fixed with a nut 42.

Although satisfying requirements for a reinforcing structure, this structure is considered to be manufactured with poor efficiency. This is because the collar 41 is separated from the fixing band 30, which requires additional work to insert the collar 41 between the pair of reinforcing ribs 18A, 18B from the side, and to adjust the positions of their holes, as well as requires an additional jig for implementing this work.

In contrast, the structure according to either of the above embodiments includes the fixing band 30 having the attaching portion 32 and the reinforcing portion 33 (or 34) which are integrally formed together. Accordingly, the structures according to the above embodiments require no special jig for assembly, and thus are expected to be manufactured with improved efficiency.

The embodiments as shown in the drawings are intended to merely illustrate the present invention, and it is apparent that the present invention encompasses various improvements and modifications that may be made by one skilled in the art within the scope of the appended claims, in addition to those directly illustrated by the embodiments described above.

Figure 4:
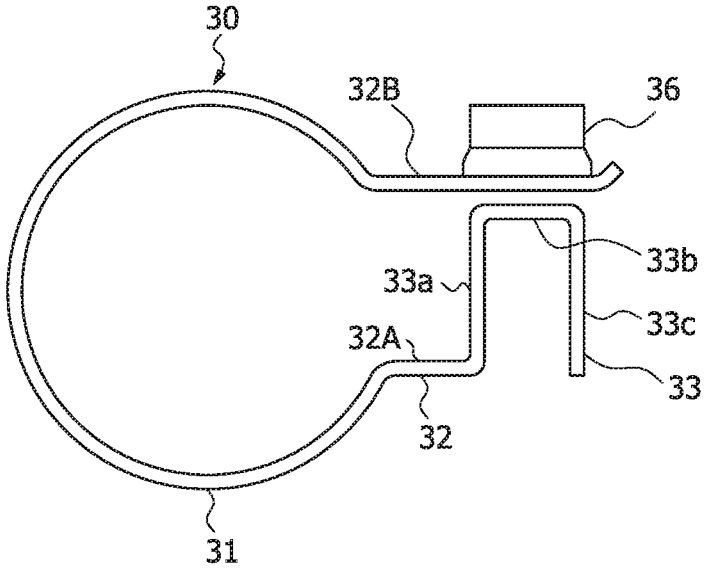
FIG. 4 is a detached view of a fixing band.
Figure 6:
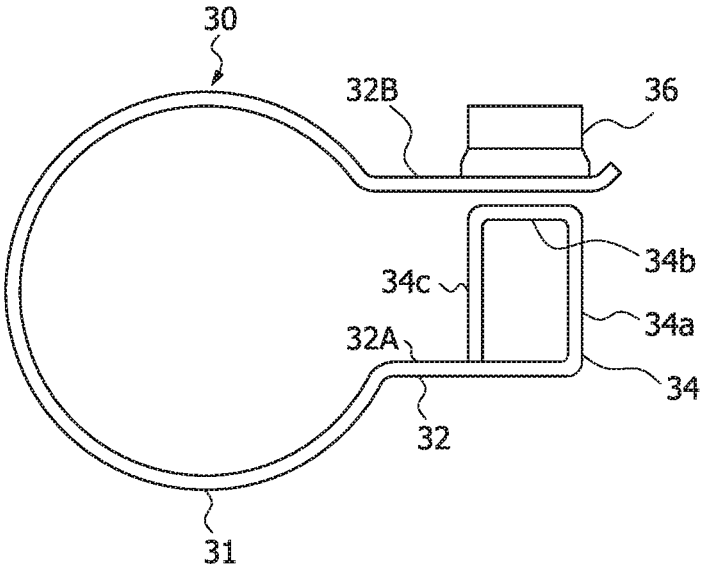
FIG. 6 is a detached view of a fixing band according to the embodiment of the present invention.

For example, in the embodiment shown in FIGS. 3 and 4 and the embodiment shown in FIGS. 5 and 6, it is also effective to modify the end, farther away from the attaching piece 32A, of the third reinforcing section 33*c* or 34*c* by, for example, further bending the end in an appropriate direction so as to provide a still stronger reinforcing structure.

REFERENCE SYMBOL LIST

1 heat exchanger
2 core portion
3, 4 header tank
5, 6 end plate
7 connector
8 bolt
10 flat tube
11, 12 partition wall
13 refrigerant inlet
14 refrigerant outlet
15, 16 partition wall
17 refrigerant outlet
18A, 18B reinforcing rib
20 liquid receiver (receiver tank)
21 inlet passage
22 outlet passage
30 fixing band
31 embracing portion
32 attaching portion
32A, 32B attaching piece
33, 34 reinforcing portion
33*a*, 34*a* first reinforcing section
33*b*, 34*b* second reinforcing section
33*c*, 34*c* third reinforcing section
35 bolt
36 nut

The invention claimed is:

1. A heat exchanger with a liquid receiver, comprising:
the heat exchanger including:
a core portion through which refrigerant vertically flows while exchanging heat with external air;
a pair of upper and lower header tanks horizontally disposed at upper and lower ends of the core portion; and
a pair of right and left end plates vertically disposed at right and left ends of the core portion;
the liquid receiver being cylindrical and disposed along one of the right and left end plates;
a fixing band for fixing the liquid receiver to the one of the right and left end plates;
wherein each of the end plates is formed to have a C-shaped cross section, having a pair of reinforcing ribs protruding outward in a right-left direction from front and back edges of the end plate;
wherein the fixing band includes:
an embracing portion formed in a loop for embracing the liquid receiver;
an attaching portion for attaching to the one of the right and left end plates, the attaching portion being formed continuously with the embracing portion; and
a reinforcing portion formed integrally with the attaching portion so as to be fitted between the pair of reinforcing ribs;
wherein the attaching portion includes a pair of attaching pieces extending from opposite ends of the embracing portion;
wherein the reinforcing portion is formed integrally with one of the attaching pieces of the pair of attaching pieces; and
wherein, the one of the attaching pieces and the reinforcing portion formed integrally with the one of the attaching pieces are disposed between the pair of reinforcing ribs of the end plate, the other attaching piece is disposed external to one of the reinforcing ribs, and the fixing band is fixed to the end plate with a nut and a bolt inserted through the reinforcing ribs, the reinforcing portion and the other attaching piece.

2. The heat exchanger with the liquid receiver according to claim 1, wherein the nut is welded prior to the assembly to the other attaching piece.

3. The heat exchanger with the liquid receiver according to claim 1, wherein the embracing portion, the attaching portion, and the reinforcing portion of the fixing band have the same width as each other in an axial direction of the liquid receiver.

4. A heat exchanger with the liquid receiver, comprising:
the heat exchanger including:
a core portion through which refrigerant vertically flows while exchanging heat with external air;
a pair of upper and lower header tanks horizontally disposed at upper and lower ends of the core portion; and
a pair of right and left end plates vertically disposed at right and left ends of the core portion;
the liquid receiver being cylindrical and disposed along one of the right and left end plates;
a fixing band for fixing the liquid receiver to the one of the right and left end plates;
wherein each of the end plates is formed to have a C-shaped cross section, having a pair of reinforcing ribs protruding outward in a right-left direction from front and back edges of the end plate;
wherein the fixing band includes:
an embracing portion formed in a loop for embracing the liquid receiver;
an attaching portion for attaching to the one of the right and left end plates, the attaching portion being formed continuously with the embracing portion; and
a reinforcing portion formed integrally with the attaching portion so as to be fitted between the pair of reinforcing ribs;
wherein the attaching portion includes a pair of attaching pieces extending from opposite ends of the embracing portion;
wherein the reinforcing portion is formed integrally with one of the attaching pieces of the pair of attaching pieces; and;
wherein the reinforcing portion includes: a first reinforcing section extending toward the other attaching piece from a bend at an outer end of the one attaching piece; a second reinforcing section extending in parallel with the other attaching piece from an outward bend at an end, farther away from the one attaching piece, of the first reinforcing section; and a third reinforcing section extending in parallel with the first reinforcing section from a bend at an outer end of the second reinforcing section.

5. The heat exchanger with the liquid receiver according to claim 4, wherein the third reinforcing section is disposed in parallel with a plate surface of the end plate.

6. A heat exchanger with a liquid receiver, comprising:
the heat exchanger including:
a core portion through which refrigerant vertically flows while exchanging heat with external air;
a pair of upper and lower header tanks horizontally disposed at upper and lower ends of the core portion; and
a pair of right and left end plates vertically disposed at right and left ends of the core portion;
the liquid receiver being cylindrical and disposed along one of the right and left end plates;
a fixing band for fixing the liquid receiver to the one of the right and left end plates;
wherein each of the end plates is formed to have a C-shaped cross section, having a pair of reinforcing ribs protruding outward in a right-left direction from front and back edges of the end plate;
wherein the fixing band includes:
an embracing portion formed in a loop for embracing the liquid receiver;
an attaching portion for attaching to the one of the right and left end plates, the attaching portion being formed continuously with the embracing portion; and
a reinforcing portion formed integrally with the attaching portion so as to be fitted between the pair of reinforcing ribs;
wherein the attaching portion includes a pair of attaching pieces extending from opposite ends of the embracing portion;
wherein the attaching portion is formed integrally with one of the attaching pieces of the pair of attaching pieces; and;
wherein the reinforcing portion includes: a first reinforcing section extending toward the other attaching piece from a bend at an outer end of the one attaching piece; a second reinforcing section extending in parallel with the other attaching piece from an inward bend at an end, farther away from the one attaching piece, of the first reinforcing section; and a third reinforcing section extending in parallel with the first reinforcing section from a bend at an inner end of the second reinforcing section so as to be in contact with the one attaching piece.

7. The heat exchanger with the liquid receiver according to claim 6, wherein the third reinforcing section is disposed in parallel with a plate surface of the end plate.

* * * * *